United States Patent [19]

Voegele, Jr.

[11] 4,051,633

[45] Oct. 4, 1977

[54] TOP HUNG SLIDING WINDOW ASSEMBLY

[76] Inventor: William P. Voegele, Jr., 8308 Post Road, Allison Park, Pa. 15101

[21] Appl. No.: 691,825

[22] Filed: June 1, 1976

[51] Int. Cl.[2] ..... E05D 13/02

[52] U.S. Cl. ..... 49/411; 52/207

[58] Field of Search ..... 49/409, 410, 411, 412; 160/196, 197; 52/207; 16/87 R, 93 R

[56] References Cited

U.S. PATENT DOCUMENTS

| | | | |
|---|---|---|---|
| 1,269,133 | 6/1918 | Townsend | 16/93 R |
| 2,766,857 | 10/1956 | Miller | 49/411 |
| 3,114,943 | 12/1963 | Casebolt | 49/411 R |
| 3,457,677 | 7/1969 | Ziegler | 49/409 |
| 3,615,144 | 10/1971 | Plemeng | 49/411 |
| 3,683,451 | 8/1972 | Tanner | 49/410 X |
| 3,808,633 | 5/1974 | Lauterbach | 49/409 X |

*Primary Examiner*—Philip C. Kannan

*Attorney, Agent, or Firm*—Webb, Burden, Robinson & Webb

[57] ABSTRACT

The window assembly comprises a main frame made up of an extruded head, sill and side members. A stationary panel is secured within the frame. A sliding panel independently framed is secured to the main head extrusion through an elongated, rigid plastic key which is secured to the top of the slider head frame member of the sliding panel. The plastic key is slidably positioned in a keyway channel extending along the main frame head extrusion so as to suspend the sliding panel therefrom as the sole means of support. Both the keyway channel and the key have downwardly sloping, mating surfaces along which the sliding panel is suspended. A portion of the key may be metal and an integral part of the slider head as long as plastic inserts are used to avoid metal to metal contact. Spaced and overlapping leg sections of the sliding panel frame and the main frame restrain the sliding panel in the main frame should the key become disengaged or broken.

12 Claims, 5 Drawing Figures

TOP HUNG SLIDING WINDOW ASSEMBLY

FIELD OF THE INVENTION

My invention is directed to a window assembly and, more particularly, to a heavy duty, metal framed sliding window intended for use in industrial residential, or commercial applications.

DESCRIPTION OF THE PRIOR ART

Most sliding windows are either top hung via roller supports or else their weight is transferred to a frame along the bottom of their sliding portion. In the latter case, commonly there are either rollers at the bottom of the sliding unit or else the unit simply is caused to slide in a channel, the bearing surface thereof being plastic. Such windows have not been acceptable for industrial applications. Many types of industrial applications present an environment which includes dust, grime, particulate matter and certain types of corrosive media. These types of windows often become jammed and inoperative as these various materials collect in the top and bottom trackways or guides which accommodate the sliding panel. These assemblies must be routinely cleaned at substantial labor and expense if they are to be kept in proper working order to provide proper ventilation for the factory or other commercial building.

At the same time the window assembly should be constructed in a way that accidental damage to the window does not result in substantial portions of the window and window frame becoming free falling objects. Multiple rollers tend to complicate the sliding mechanism since a malfunction of any single roller tends to affect the performance of the entire window assembly. In addition, many window assemblies include metal to metal contact between the sliding frame and the fixed frame. This also leads to poor relative sliding movement, and of course a lubricant tends to collect the dirt and grime thereby solving one problem but creating another.

SUMMARY OF THE INVENTION

My window assembly overcomes the maintenance problems associated with sliding window roller mechanisms by eliminating the roller mechanisms and replacing them with a continuous, rigid, vinyl key or key insert. My invention further eliminates bottom guides. My invention further provides for the near elimination of particulate matter accumulation in the keyway by providing sloped surfaces which permit the particulate matter to fall out of the keyway or be forced out of the keyway as the sliding panel moves therealong. Because of the openness of the movable members, my assembly can be easily cleaned. My invention also provides for safety means to assure that the window panels are retained within the assembly even if breakage occurs in the panel, key or the frame members. Further, my invention eliminates all metal-to-metal contact between the sliding frame and the fixed frame.

My invention is a sliding window assembly for use in industrial residential and commercial applications. The main frame made of metal extrusions includes a head member having an open channel extending therealong on the inside of the frame and defined in part by downwardly sloping bottom surfaces. The main frame also includes side extrusions and an extruded sill member. A sliding, framed panel is suspended from the main frame by means of a plastic key secured at one end to the top of the slider head member of the sliding panel and at the other end to the head member channel in which it is free to slide. The plastic key includes downwardly sloping surfaces which cooperate with the sloping surfaces of the main head member. Key inserts may be employed in combination with a metal key which is a part of the sliding frame panel. The main frame is provided with leg sections which do not engage the sliding panel but which restrain the sliding panel in the event it becomes disengaged from the main frame.

DESCRIPTION OF THE PREFERRED EMBODIMENTS

Figure 1:
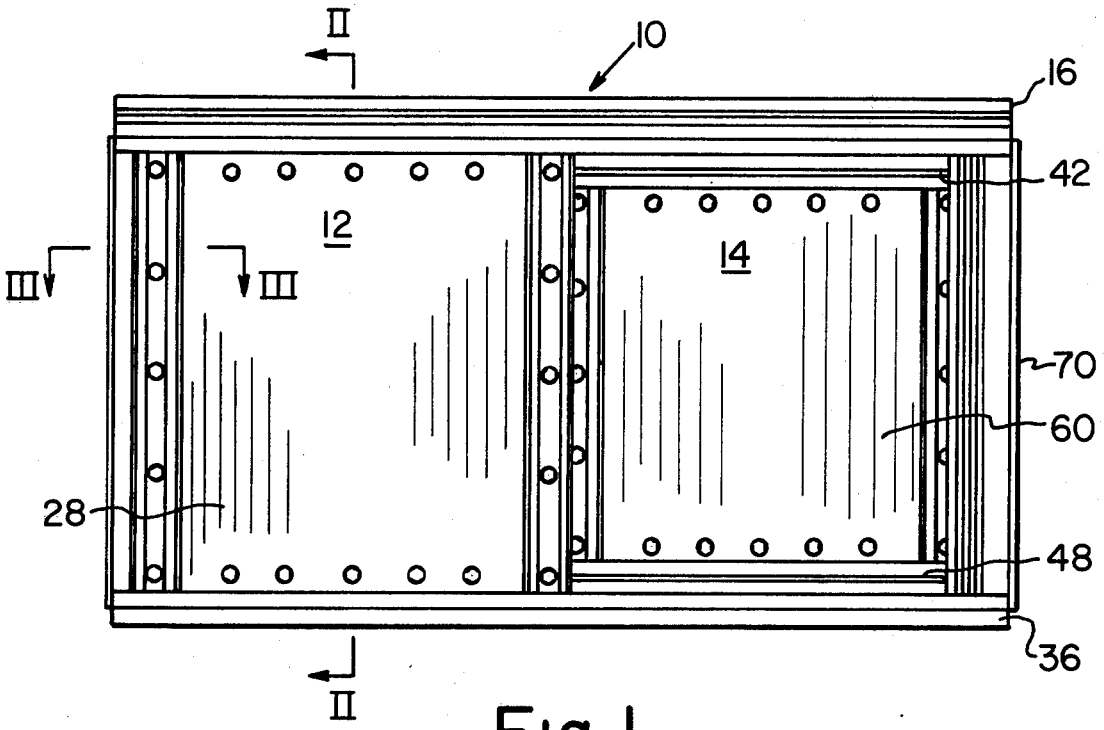
FIG. 1 is an elevation of my sliding window assembly.

My window assembly, generally designated 10, includes a main frame and fixed panel 12 and a sliding panel 14, FIG. 1. The window assembly 10 is normally made of metal extrusions of aluminum or the like and the glazing for the window is normally plastic, fiberglas or some other similar material which may be flat or corrugated. The glazing may even be an insulated panel. In any case, it may be clear, translucent or opaque. The window's primary use is for industrial or commercial application where the window assembly will be subjected to a corrosive and/or unclean environment, but it may also be used in less demanding applications such as residential.

Figure 3:
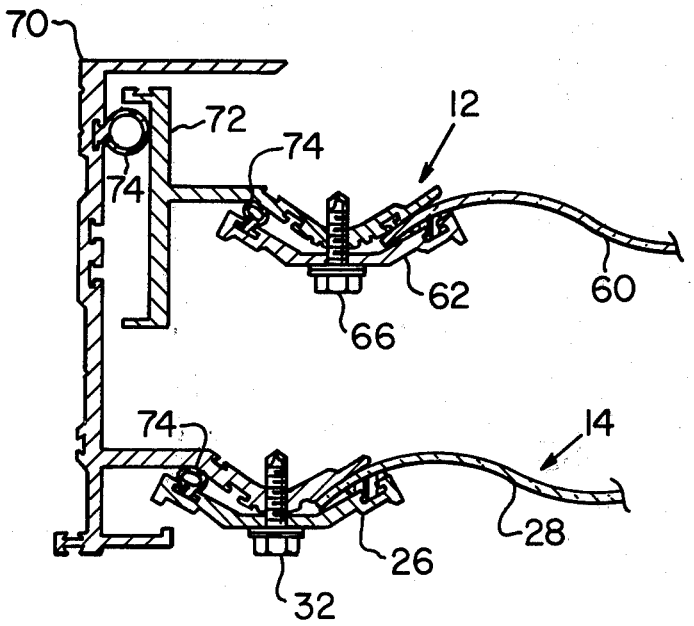
FIG. 3 is a section taken along section lines III—III of FIG. 1 with the sliding panel in the open position.
Figure 2:
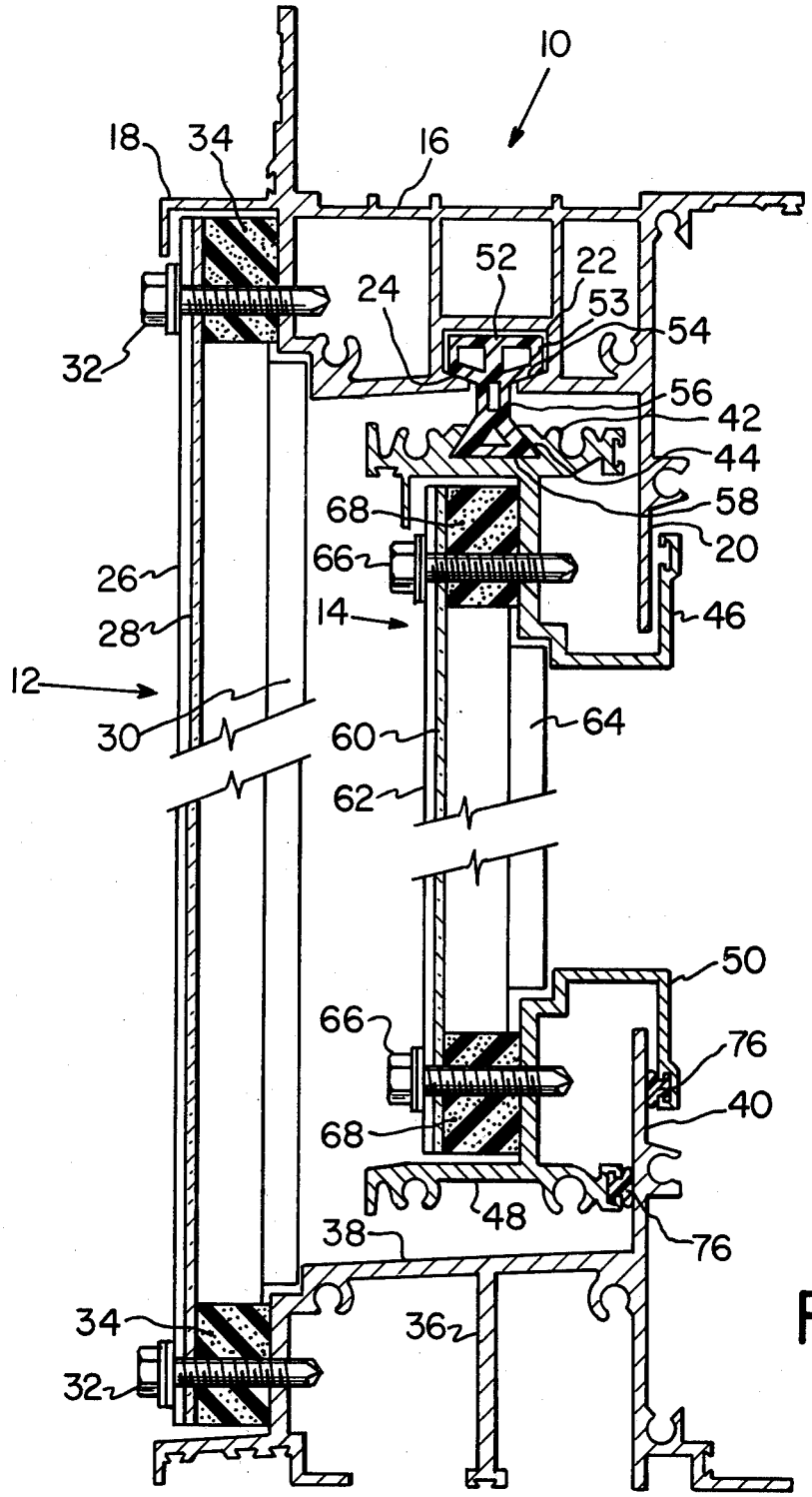
FIG. 2 is a section taken along section lines II—II of FIG. 1 with the sliding panel in the open position.

The main frame comprises a main head extrusion 16, two main side extrusions 70 and a main sill extrusion 36, FIGS. 1-3. Main head extrusion 16 includes a drip cap 18 that extends therealong and over the fixed panel 12 and sliding panel 14 so that condensation or other water which attempts to flow to the underside of the extrusion 16 will tend to run off outside the window assembly 10 and, more particularly, the sliding panel 14. The main head extrusion 16 also includes a downwardly extending leg 20 positioned rearward of the fixed panel 12 and sliding panel 14. An elongated keyway 22 extends the length of main head extrusion 16 along the underside thereof. Keyway 22 is defined in part by downwardly sloped surfaces 24 which terminate in spaced relationship so as to define an opening therebetween.

The main sill extrusion 36 likewise extends the length of the window assembly and includes a sloping surface 38 which also acts to direct water to the outside of the window. An integral leg 40 extends upward from main sill extrusion 36 at the rear thereof and in axial alignment with leg 20 of main head extrusion 16, FIGS. 1 and 2.

The fixed panel 12 includes a corrugated glazing 28 normally of a translucent material such as plastic or fiberglas which is secured to the main head extrusion 16 and the main sill extrusion 36 by self-drilling, stainless steel fasteners 32. Foam closure strips 34 are positioned behind the translucent glazing 28 at its upper and lower ends to form a weather seal. Mullion cap 26 is utilized to hold the glazing 28 against the frame members and where the windows are of substantial vertical dimension, a mullion extrusion 30 is inserted behind the glazing 28 to provide additional support, FIG. 2.

The sliding panel 14 also includes a slider head extrusion 42, slider frame sides 72 and a slider sill extrusion 48, FIGS. 2 and 3. The slider head extrusion 42 includes an elongated recess 44 extending along the top surface thereof substantially triangular configuration as will be described hereinafter, FIG. 2. An integral, L-shaped leg 46 extends outward from the slider head extrusion 42 and is positioned in rearward spaced but overlapping relationship with the leg 20 of the main head extrusion 16 in the assembled position. In a similar manner, slider sill extrusion 48 includes an integral leg 50 which is substantially L-shaped and which is in overlapping and rearward spaced relationship to leg 40 of main sill extrusion 36. The corrugated, translucent glazing 60 is attached to the slidable panel 14 in a manner similar to the attachment of the glazing 28 of the fixed panel 12. A mullion cap 62 and fastener 66 are provided as the means of joining the glazing 60 to the slider head extrusion 42 and the slider sill extrusion 48. In addition, a mullion extrusion 64 is utilized for additional support and the glazing is secured to the sliding panel by the fasteners 66 through the mullion cap, mullion and appropriate upper and lower foam weatherstripping 68.

The sliding panel 14 is suspended from the main head extrusion 16 by means of a rigid vinyl or nylon key 52, FIG. 2. The term plastic key will be used hereinafter to include vinyl, nylon and those other nonmetallic materials recognizable to those skilled in the art as having the physical and chemical properties necessary to act as a non-metallic key. Key 52 is permanently fixed in the slider head extrusion 42 through the lower key section 58 which has a substantially triangular configuration for mating relationship with the recess 44 in the slider head extrusion 42. Extending upward from the lower key section 58 is a web 56 which extends through the opening in the keyway 22 formed by the sloped surfaces 24. Upper section 53 of key 52 is configured in cross section similar to the keyway 22 and includes downwardly sloping surfaces 54 which matingly engage and slide along the sloping surfaces 24 of keyway 22. The effect of this configuration is to cause the dust and dirt and other particulate matter to work its way out of the friction area as the window is being used. The key 52 also serves as the wearing surface during the sliding operation and there is no metal to metal contact between the sliding panel 14 and the fixed panel 12.

The main side extrusions 70 of the window assembly 10 provide the end stops for the sliding panel 14, FIG. 3. Appropriate weatherstripping 74 is positioned between the fixed panel 12 and the main side extrusion 70. In addition, appropriate weatherstripping 74 is positioned between the sliding panel side extrusion 72 and the mullion cap 26 and translucent glazing 28. A pile stripping 76 is utilized on either side of leg 40 of main sill extrusion 36 by securing the stripping 76 to leg 50 and the terminal end of slider sill extrusion 48, FIG. 2. This stripping 76 performs a dual purpose in that it acts as weatherstripping and it eliminates any metal to metal contact between the main sill extrusion 36 and particularly leg 40 and the slider sill extrusion 48.

In operation, the sliding panel 14 is merely moved along the keyway 22 to open and close the window assembly 10. The sliding panel 14 is securely restrained through legs 40 and 20 by legs 46 and 50 of the slider head extrusion 42 and slider sill extrusion 48, respectively, so that the sliding panel 14 cannot fall out of the main frame in the event the panel or key is damaged or broken.

Figure 4:
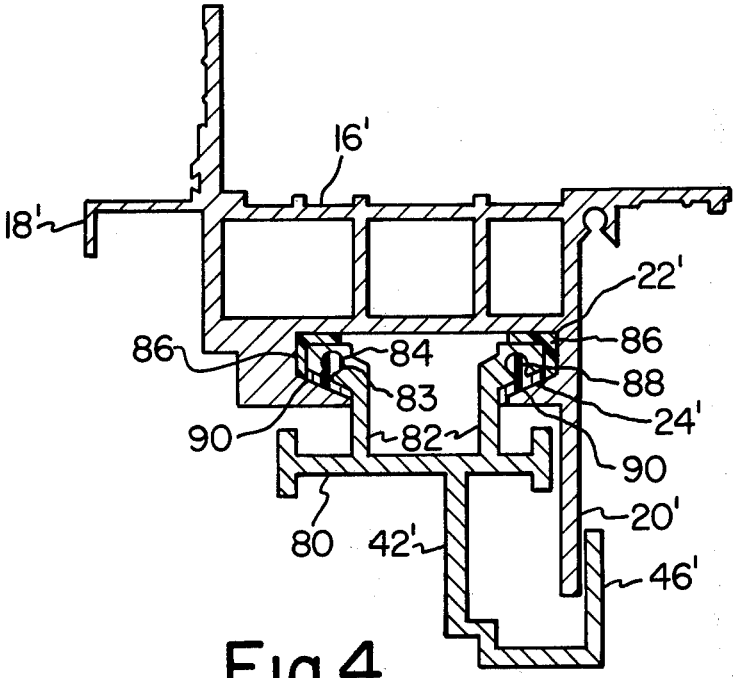
FIG. 4 is a section through another embodiment of my invention.
Figure 5:
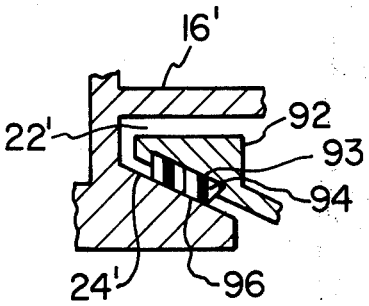
FIG. 5 is a section through a modified plastic insert.

Further embodiments are illustrated in FIGS. 4 and 5, with similar parts identified by the same numerals followed by a prime.

The main head extrusion 16' includes drip cap 18', leg 20' and elongated keyway 22' having downwardly sloping surfaces 24' as in the earlier embodiment, FIG. 4. The slider head extrusion 42' is also similar to the earlier embodiment except that a portion of the key is made of metal and is integral with the slider head extrusion 42'. Opposing parallel metal legs 82 extend upward as an integral part of extrusion 42'. Each leg 82 includes an enlarged mass portion 83 having a substantially circular, elongated keyway 84 therein. The enlarged mass portion 83 is in spaced relationship to the keyway 22' so there is no metal to metal contact. An elongated, rigid, plastic insert 86 joins to the enlarged mass portion 83 through an elongated, circular in cross section key 88 which matingly engages with keyway 84. Insert 86 is somewhat U-shaped with one leg of the U forming a sloping surface 90 which slides along sloping surface 24'. Therefore, each leg 82 includes a plastic insert 86 which then functions similar to the entire key of the earlier embodiment. The two legs 82 could be a single, solid piece to give further rigidness to the structure where desired.

The plastic insert may even be smaller as illustrated in FIG. 5. Main head extrusion 16' includes the keyway 22' having the downwardly sloping surfaces 24'. The terminal end of leg 92 of the slider head extrusion (not shown) includes an elongated, trapezoidal in cross section keyway 93 into which is secured an elongated plastic insert 94. Plastic insert 94 includes an exterior downwardly sloped surface 96 which slides against sloping surface 24' of the keyway 22'. Such an insert 94 is likewise mounted in a second leg 92 (not shown) similar to the embodiment of FIG. 4.

Both embodiments, i.e., FIGS. 4 and 5, operate in the same manner as the earlier embodiment in that metal to metal contact is avoided and the mating, sloped surfaces assist in eliminating dirt and particle collection as the slider frame moves relative to the main head extrusion.

I claim:

1. A sliding window assembly comprising:

A. a metal frame made up of a head member, a sill member and two side members, said head member including a channel extending therealong on the inside of the frame and defined in part by two downwardly sloping planar bottom surfaces which terminate in spaced apart relationship to define an opening into the channel;

B. a stationary panel including a glazing and secured to a first part of the frame;

C. a sliding panel including glazing and secured to a slider head; and

D. a rigid, plastic key secured at one end to a top of the slider head and positioned at an opposing end in the head member channel, said opposing end defined in part by sloping planar surfaces in mating engagement with the sloping bottom surfaces of the channel so as to permit the sliding panel to slidably move between the first part of the frame and a remaining part thereof.

2. The assembly of claim 2, including means to restrain the sliding panel in the main frame should the sliding panel become disengaged.

3. The assembly of claim 1, said key extending substantially the length of said sliding panel and comprising three sections, the first section including the one end, the second section including the opposing end and a web section joining the first and second sections and extending through the opening in the channel.

4. The assembly of claim 1, said glazing comprising translucent, corrugated sheets.

5. The assembly of claim 1, said slider head including an elongated recess in an upper surface thereof, said key being secured within said elongated recess.

6. A sliding window assembly comprising:

A. a frame made up of a head member, a sill member and two side members, said head member including a channel extending therealong on the inside of the frame and defined in part by two downwardly sloping bottom surfaces which terminate in spaced apart relationship to define an opening into the channel;

B. a stationary panel including a glazing and secured to a first part of the frame;

C. a sliding panel including glazing and secured to a slider head, said slider head including at least one leg extending into and terminating within the channel in spaced relationship therewith; and D. a rigid, plastic key secured to the leg within the channel and defined in part by sloping surfaces in mating engagement with the sloping bottom surfaces of the channel so as to permit the sliding panel to slidably move between the first part of the frame and a remaining part thereof.

7. The assembly of claim 6 including two such legs, each leg terminating in an enlarged mass portion having an elongated keyway therein, said key being a plastic insert positioned between the channel and the leg and having an elongated key mounted within said elongated keyway and including said sloped surface.

8. A heavy duty sliding window assembly comprising:

A. a fixed metal frame comprising a head extrusion, a sill extrusion and respective side extrusions, the head extrusion including a drip cap extending outward therefrom and a keyway extending substantially the head extrusion length along the underside thereof and including two downwardly extending, sloped surfaces which terminate to define the keyway opening, said sill extrusion including a downwardly sloping surface;

B. a stationary panel including a corrugated translucent glazing and secured to a first half of the frame;

C. a sliding frame movable between the first half and a second half of the frame comprising a slider head extrusion, a slider sill extrusion, respective slider side extrusions and a corrugated glazing secured to the slider extrusions, the slider head extrusion including a triangular shaped recess extending along the upper surface thereof; and D. a rigid plastic key comprising a first end triangularly configured and permanently secured within the slider head recess, a second end having downwardly sloping surfaces positioned in mating and sliding engagement within the keyway and a web section joining the two ends and extending through the keyway opening, said key being the sole means of suspending the sliding frame from the fixed frame.

9. The assembly of claim 12, said head extrusion having a leg extending downward therefrom behind the sliding frame, said sill extrusion having a leg extending upward therefrom in axial alignment with the head extrusion leg and said slider head and slider sill each having an L-shaped leg extending outward therefrom in overlapping and spaced relationship to said head extrusion and slider extrusion legs respectively.

10. A sliding window assembly comprising:

A. a metal frame made up of a head member, a sill member and two side members, said head member including a channel extending therealong on the inside of the frame and defined in part by two downwardly sloping bottom surfaces which terminate in spaced apart relationship to define an opening into the channel;

B. a stationary panel including a glazing and secured to a first part of the frame;

C. a sliding panel including glazing and secured to a slider head;

D. a rigid, plastic key secured at one end to a top of the slider head and positioned at an opposing end in the head member channel, said opposing end defined in part by sloping surfaces in mating engagement with the sloping bottom surfaces of the channel so as to permit the sliding panel to slidably move between the first part of the frame and a remaining part thereof; and E. means to restrain the sliding panel in the main frame should the sliding panel become disengaged comprising an integral leg extending downward from the head member, an integral leg extending upward from the sill member and respective substantially L-shaped legs extending outward from the sliding panel in over-lapping and spaced relationship from said integral legs.

11. A sliding window assembly comprising:

A. a metal frame made up of a head member, a sill member and two side members, said head member including a channel extending therealong on the inside of the frame and defined in part by two downwardly sloping planar bottom surfaces which terminate in spaced apart relationship to define an opening into the channel;

B. a stationary panel including a glazing and secured to a first part of the frame;

C. a sliding panel including glazing and secured to a slider head having an elongated upper recess extending substantially the length of an upper surface thereof; and D. a rigid, plastic key secured at one end in said recess and positioned at an opposing end in the head member channel, said opposing end being substantially triangular and defined in part by sloping planar surfaces in mating engagement with the sloping bottom surfaces of the channel so as to permit the sliding panel to slidably move between the first part of the frame and a remaining part thereof.

12. In a sliding window assembly having a metal frame including a main head extrusion and multiple panels, at least one of which is slidable, the improvement comprising a plastic key extending substantially the length of the slidable panel and a keyway in the main head extrusion for suspending the slidable panel as the sole means of support, said keyway extending substantially the length of the head extrusion and defined in part by two downwardly sloping planar surfaces which terminate in spaced apart relationship to define an opening into the channel, said key having a first portion secured to the slidable panel, a second portion positioned in the keyway and having downwardly sloping surfaces in mating relationship with said surfaces of the keyway and a web portion connecting the first and second portions and extending through said opening.

* * * * *

UNITED STATES PATENT AND TRADEMARK OFFICE

CERTIFICATE OF CORRECTION

PATENT NO. : 4,051,633

DATED : October 4, 1977

INVENTOR(S) : William P. Voegele, Jr.

It is certified that error appears in the above-identified patent and that said Letters Patent are hereby corrected as shown below.

Column 3 Line 7 After "thereof" insert --of--.

Column 4 - Claim 2 Line 66 "claim 2" should read --claim 1--.

Column 5 - Claim 9 Line 64 "claim 12" should read --claim 8--.

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*